US010080429B2

(12) United States Patent
Schiraga

(10) Patent No.: US 10,080,429 B2
(45) Date of Patent: Sep. 25, 2018

(54) SURFACE ADAPTIVE TENSION-COMPRESSION BASE STRUCTURE

(71) Applicant: Seton Schiraga, Alameda, CA (US)

(72) Inventor: Seton Schiraga, Alameda, CA (US)

( * ) Notice: Subject to any disclaimer, the term of this patent is extended or adjusted under 35 U.S.C. 154(b) by 0 days.

(21) Appl. No.: 14/736,234

(22) Filed: Jun. 10, 2015

(65) Prior Publication Data

US 2015/0351548 A1 Dec. 10, 2015

Related U.S. Application Data

(60) Provisional application No. 62/009,912, filed on Jun. 10, 2014.

(51) Int. Cl.

| | |
|---|---|
| ***A47B 3/00*** | (2006.01) |
| ***A47C 4/04*** | (2006.01) |
| ***A47C 4/28*** | (2006.01) |
| ***A47C 9/10*** | (2006.01) |
| ***A47C 7/00*** | (2006.01) |

(52) U.S. Cl.

CPC ..... *A47B 3/00* (2013.01); *A47C 4/04* (2013.01); *A47C 4/286* (2013.01); *A47C 7/008* (2013.01); *A47C 9/105* (2013.01); *A47B 3/002* (2013.01); *A47B 2220/09* (2013.01)

(58) Field of Classification Search

CPC .. A47B 3/00; A47C 4/04; A47C 4/286; A47C 7/008; A47C 9/105

USPC ..... 297/16.1, 16.2

See application file for complete search history.

(56) References Cited

U.S. PATENT DOCUMENTS

| | | | | | |
|---|---|---|---|---|---|
| 2,139,673 | A * | 12/1938 | Draper | A47C 9/105 | 108/128 X |
| 3,063,521 | A | 11/1962 | Buckminster | | |
| 4,148,520 | A * | 4/1979 | Miller | A47C 4/286 | 297/16.2 |
| 4,266,748 | A * | 5/1981 | Dalton | A01M 31/02 | 297/4 |
| 4,290,643 | A * | 9/1981 | Logan, III | A47C 4/286 | 297/16.2 X |
| 4,585,270 | A * | 4/1986 | Singer | A47C 3/00 | 297/16.1 |
| 4,934,638 | A * | 6/1990 | Davis | A47C 4/286 | 108/118 |
| 6,634,704 | B1 * | 10/2003 | Bergquist | A47C 9/105 | 297/16.2 |
| 6,871,905 | B2 * | 3/2005 | Grace | A47C 9/105 | 297/16.2 |
| 6,901,714 | B2 | 6/2005 | Liapi | | |

(Continued)

*Primary Examiner* — Anthony D Barfield

(74) *Attorney, Agent, or Firm* — Innovation Capital Law Group, LLP; Vic Lin

(57) ABSTRACT

A tension-compression base structure including tension elements (such as flexible cables or ropes) and compression elements (such as rigid legs) is provided with a slidably adjustable path for the tension elements around or within the compression elements, thereby enabling a degree of adaptability to support surfaces that may not be ideally flat, such as on outdoor terrain. Such a tension-compression base may be used to support a platform, a stool, or an item of equipment that may be desirably held in a preferred orientation irrespective of terrain irregularities, and as furniture may be configured to rock with a user's body as a form of active seating.

20 Claims, 6 Drawing Sheets

(56) References Cited

U.S. PATENT DOCUMENTS

| | | | | |
|---|---|---|---|---|
| 7,370,908 | B2 * | 5/2008 | Crowell | A47C 4/02 297/16.2 X |
| 8,616,328 | B2 * | 12/2013 | Daraio | G10K 15/00 135/120.4 |

* cited by examiner

SURFACE ADAPTIVE TENSION-COMPRESSION BASE STRUCTURE

FIELD OF THE INVENTION

The invention relates to base structures capable of supporting a mass over a support surface, and more particularly to adaptive tension-compression base structures capable of holding a preferred orientation over irregular terrain.

BACKGROUND OF THE INVENTION

The term "tensegrity" was originally coined by futurist designer and inventor R. Buckminster Fuller in the 1960s to describe systems of tension elements (e.g., ropes, cables, or cords) and compression elements (e.g. bars, rods, tubes, or other rigid strut-type components) held in a state of static pre-stressed equilibrium to define a three-dimensional frame structure, wherein the compression elements generally do not touch each other. The pulling forces applied by the tension elements are resisted by the rigid compression elements, and a tensegrity system remains stable even against externally applied forces. The word "tensegrity" itself combines "tension" and "structural integrity." Fuller's U.S. Pat. No. 3,063,521 (filed in 1959 and issued in 1962) covers various basic tensegrity concepts, and Fuller and others have patented many variations since then.

When properly designed and constructed, tensegrity structures have proven to be robust and durable. Pioneering sculptor Kenneth Snelson's well-known "Needle Tower" sculpture, constructed of metal tubes and wire, has stood outdoors at the Hirshhorn Museum in Washington, D.C. for decades. Tensegrity structures can be suitable for furniture as well. A line of tensegrity sitting stools named after Snelson is offered by designer Sam Weller (samweller-.co.uk).

The tensegrity concept has been well developed and used frequently in the decades since the 1960s (and even before then, as some structures—including the London Skylon tower dating from 1951—employed some tensegrity principles even before the term was coined). Tensegrity is capable of enabling lightweight but robust structures combined with artful design; there are many designs for furniture, bridges, buildings, sports stadiums, toys, and other structures—large and small—that employ tensegrity principles.

But for all their benefits, most tensegrity structures remain rigid and poorly adapted to use upon irregular surfaces. The pre-stressed balance between tension and compression provides little freedom for movement. Because of this, tensegrity furniture is not often suitable for use outdoors. The Snelson stools referenced above, for example, remain flat and balanced only on a flat floor; on an inclined surface the entire structure including the seating surface will also be inclined and vulnerable to tipping over, and on an irregular surface the legs of the stool will wobble. This, unfortunately, also holds true for many other pieces of tensegrity furniture.

Accordingly, there is a need for an adaptive tension-compression structure based on tensegrity principles but more capable of being used on inclined and irregular surfaces. Such a structure would be easily adjustable to various support surfaces and yet remain strong and stable as furniture or as a base for equipment or other objects.

SUMMARY OF THE INVENTION

An adaptive tension-compression structure according to Applicant's invention addresses some of the shortcomings of prior tensegrity structures described above.

Like many of these prior structures, the basic form of a tension-compression structure according to the invention is a tensegrity prism—in its simplest form, three compression elements held together with tension elements in a shape that resembles a twisted triangular prism. However, the present tension-compression structure includes a slidably adjustable path for the tension elements holding the compression elements together. The sliding adjustability of the tension elements provides additional compliance (in the circumferential direction) for the structure while maintaining its basic geometry, thereby providing a stable base for furniture or any other suitable structure—including but not limited to equipment that may be desirably held in a preferred orientation over a variable or irregular surface.

A tension-compression structure according to the invention may also be employed as a base for "active seating" furniture on a level surface or an irregular surface. The slidably adjustable tension elements allows a structure according to the invention to rock somewhat, subject to the user's control, encouraging some muscle activity to keep the structure (such as a stool) in a preferred position.

In an embodiment of a tension-compression structure according to the invention, the compression elements are hollow tubes that serve as pathways for the tension elements. However, in an alternative embodiment, the tension elements may also be provided with pathways adjacent to the compression elements.

In several possible embodiments of the invention the tension-compression structure is collapsible for storage or transportation. In one embodiment, one of the compression elements is axially collapsible via a spring-biased detent (or another suitable locking mechanism), thereby releasing the pre-stress on the system and enabling the structure to be broken down into a bundle of parallel legs (with some flexible parts folded therein). In another embodiment, a connector integrated into a tension element may be disconnected, thereby once again enabling the structure to be collapsed into a bundle.

With the present tension-compression structure in an uncollapsed state, when weight is applied, constraints applied by an upper platform and a lower set of tension segments prevent the structure from losing its integrity, while the sliding tensegrity tension elements accommodate surface irregularities until a stable position is reached.

Accordingly, then, a number of disadvantages of other known tensegrity support structures—particularly their shortcomings on irregular terrain and their inability to be collapsed for storage or portability—are addressed by the tension-compression structures of the invention.

BRIEF DESCRIPTION OF THE DRAWINGS

These and other objects, features, and advantages of the invention will become apparent from the detailed description below and the accompanying drawings, in which.

DETAILED DESCRIPTION OF THE INVENTION

The invention is described below, with reference to detailed illustrative embodiments. It will be apparent that a tension-compression base structure according to the invention may be embodied in a wide variety of forms. Consequently, the specific structural and functional details disclosed herein are representative and do not limit the scope of the invention.

Figure 1:
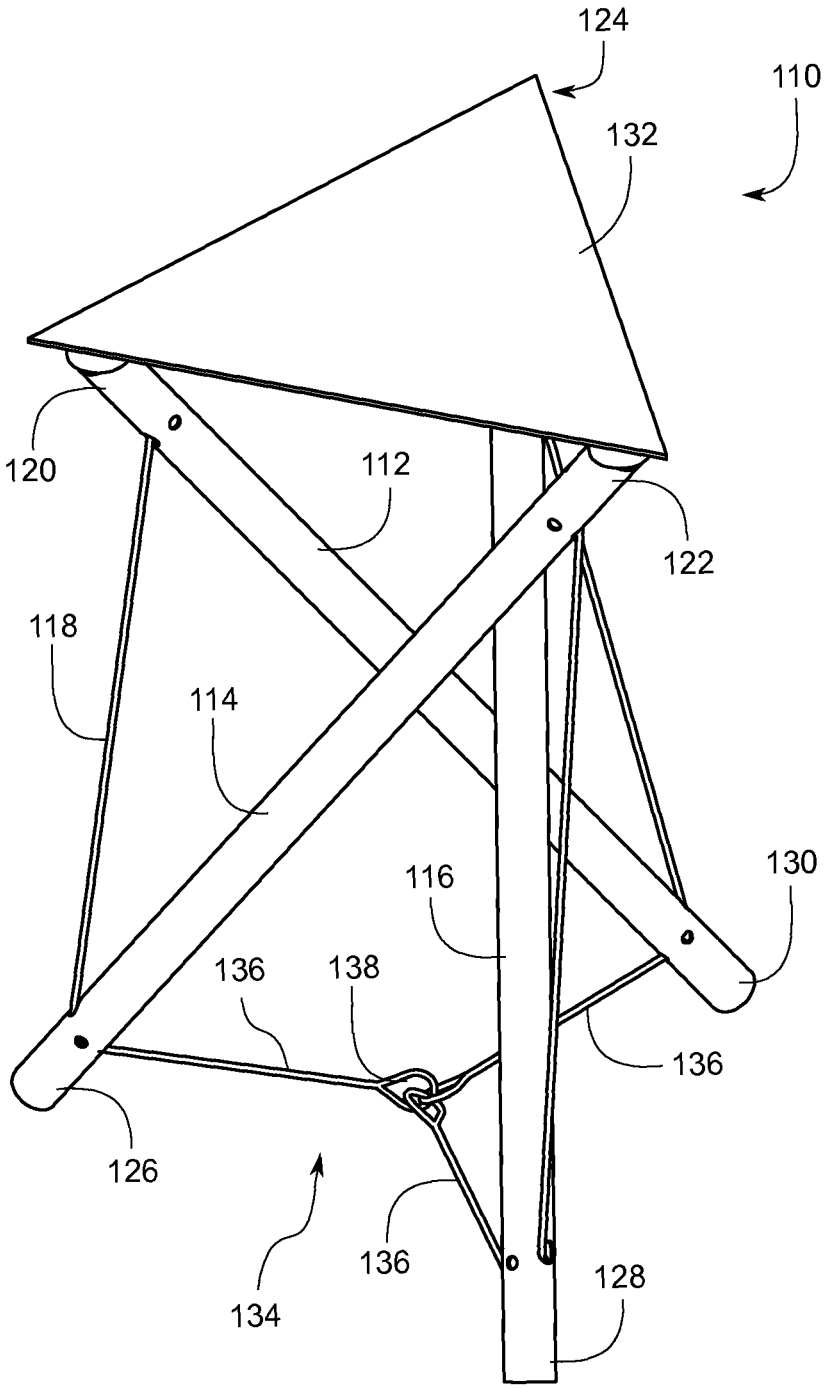
FIG. 1 is a perspective view of a base structure according to the invention capable of serving as a stool, including three compression elements serving as legs and an upper surface seating platform.

FIG. 1 illustrates a tension-compression base structure 110 according to the invention configured as a stool. There are three compression elements 112, 114, and 116 illustrated and serving as legs; they are arranged generally as a tensegrity prism—i.e., as illustrated, a triangular prism wherein the top and bottom triangles are rotated with respect to each other. This arrangement, with tension elements 118 stretched between a first (upper) end 120, 122, and 124 of each of the legs and a second (lower) end 126, 128, and 130 of one of the adjacent legs, is a stable tensegrity configuration. Although FIG. 1 shows three compression elements or legs 112, 114, and 116, it should be noted that tensegrity configurations are possible having other numbers of compression elements. It should further be noted that the arrangement of the legs might not be strictly prismatic, as the term is generally understood; the leg spacing at the upper ends may differ from the spacing at the lower ends.

The stool 110 of FIG. 1 includes a platform 132 at the upper end. As illustrated, the platform may be essentially rigid, or in an embodiment of the invention it may be soft and compliant (and, for example, made from a suitable fabric). This platform 132 serves as a seat for the stool 110. Regardless of whether the platform 132 is rigid or flexible, the platform also maintains the upper ends 120, 122, and 124 of the legs 112, 114, and 116 in a desired maximum spacing, which in the case of the illustrated stool 110 is essentially an equilateral triangle (though in alternative embodiments of the invention, the triangle need not be equilateral). The platform prevents the upper ends 120, 122, and 124 of the legs 112, 114, and 116 from moving outward more than the size of the platform 132 accommodates. Accordingly, if the platform 132 is rigid, the legs 112, 114, and 116 may be pivotably attached at or near a periphery of the platform 132 in a triangular configuration. If the platform 132 is soft and flexible, pockets may be formed near the edge of the platform 132 to accommodate the upper ends 120, 122, and 124 of the legs 112, 114, and 116, or the legs may be flexibly fastened to the platform 132 in another suitable manner. In an embodiment of the invention the pockets are spaced relatively equally around the perimeter of the platform, but they need not be evenly spaced.

In the illustrated embodiment, the compression elements, or legs 112, 114, and 116, are fabricated from tubes of a suitably strong metal, such as steel, though other materials may of course be used. This tubular construction enables a lightweight structure. Feet may be provided at the lower ends of the legs to provide good frictional contact with the terrain; such feet may optionally be pivoting.

When tubes are used as the compression elements 112, 114, and 116, the tension elements 118 extending between the upper portions of each leg and the lower portion of adjacent legs may be formed from a single loop of rope or cable; this configuration will be discussed further in connection with FIG. 10 below. In this disclosed single loop configuration, the tension elements 118 extend externally between an upper portion 120 of a first leg 112 and a lower portion 126 of a second leg 114, then internally within the tube-shaped second leg 114 from its lower portion 126 to its upper portion 122, then externally between the upper portion 122 of the second leg 114 to a lower portion 128 of a third leg 116, then internally within the third leg 116, then externally from a upper portion 124 of the third leg 116 to a lower portion 130 of the first leg 112, then internally within the first leg 112 to the upper portion 120 thereof to complete the loop. In an embodiment of the invention, the tension elements 118 need not be positioned inside the legs; but rather, are guided adjacent to the legs by eyes, pulleys, or other suitable structures. In such a case, the legs may be made from any suitably rigid material, such as metal, wood, or some plastics or composites.

The tension-compression structure disclosed herein further includes a lower end constraint 134, which as illustrated includes a plurality of tension segments 136 (preferably flexible) fixably attached to the lower portion 126, 128, and 130 of each of the legs 112, 114, and 116 and joined at a junction 138 at a midpoint. Other embodiments of constraints are possible here; the lower end constraint 134 might take a triangular configuration (like the platform 132) or may be rigid in nature.

Figure 2:
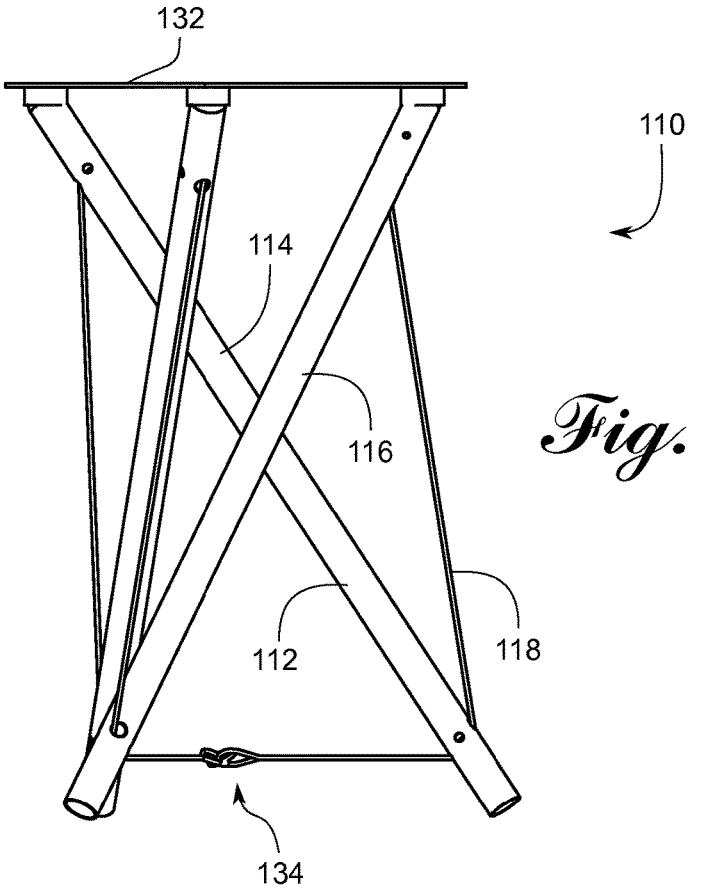
FIG. 2 is a side view of the base structure of FIG. 1.
Figure 3:
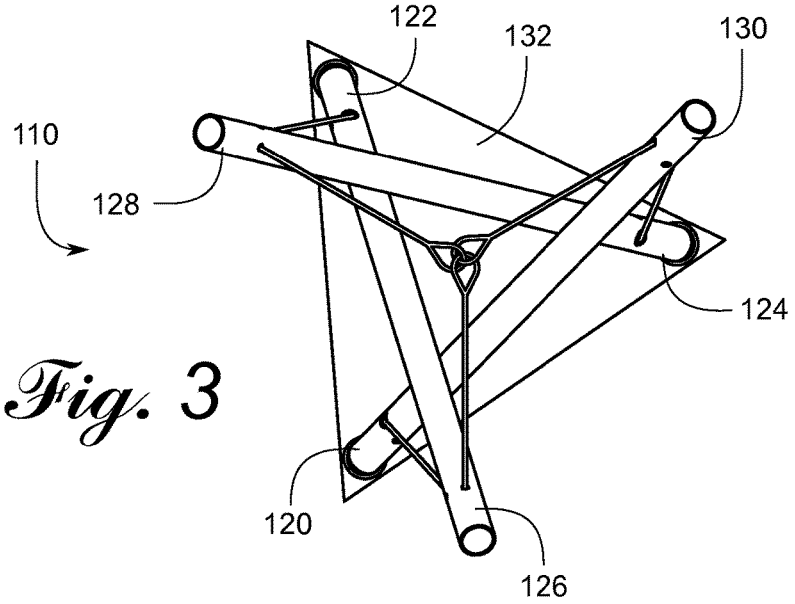
FIG. 3 is a bottom view of the base structure of FIG. 1.

FIGS. 2 and 3 illustrate the tension-compression structure of FIG. 1, but in side view and bottom view, respectively.

Figure 4:
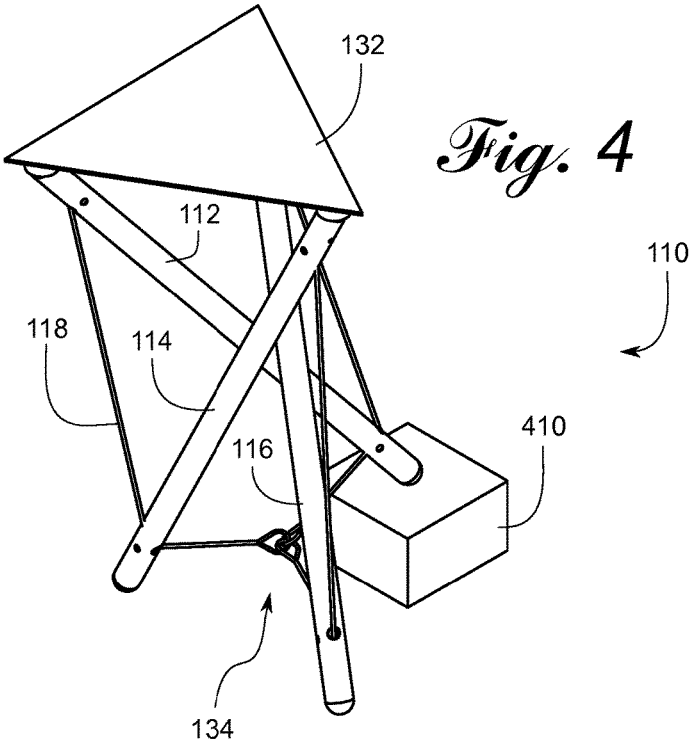
FIG. 4 is a perspective view of a base structure according to the invention with one leg situated atop a support surface irregularity.

FIG. 4 illustrates a stool 110 according to the invention placed upon a terrain irregularity, which is represented in FIG. 4 by a raised block 410. As illustrated, the stool 110 has been adjusted to accommodate the irregularity as enabled by the invention.

As shown in FIG. 4, the legs 112, 114, and 116 of a stool 110 according to the invention are constrained somewhat by the upper platform 132 and the lower constraint segments 134, but otherwise are essentially free to adjustably slide along the tensegrity tension elements 118 to accommodate irregular terrain (subject, of course, to a desirable level of friction between the legs 112, 114, and 116 and the tension elements 118 which tends to avoid excessive and undesirable adjustments as weight is placed on the stool 110).

When weight is applied, the legs 112, 114, and 116 of a tension-compression structure 110 according to the invention move outward at both top and bottom against the constraints (the upper platform 132 and the lower constraint segments 134), and individually move down and/or outward to meet the terrain. Once the legs 112, 114, and 116 are in position, the upper platform 132 can be adjusted to suit the user's needs or comfort.

The irregularity shown in FIG. 4 is exaggerated for purposes of illustration. Although a tension-compression base structure 110 according to the invention can accommodate this movement and more, it is to be expected that some instability may result as the degree of irregularity begins to exceed the capacity of the structure to move 110 to accommodate it; the center of gravity of weight placed upon the platform 132 will at some point move outside of the region bounded by the legs 112, 114, and 116 and the structure 110 may then be subject to tipping. Accordingly, a structure according to the invention is suitable for moderately irregular terrain.

An article of furniture according to the invention, such as a stool, may also be employed for "active seating" on any suitable surface. The sliding adjustability of the tension elements in a structure according to the invention allows the structure to move and comply with shifts in a user's position or center of gravity, thereby encouraging some continuous use of the user's core muscles to maintain a desired position. Some users may find this desirable, particularly in an office setting or other circumstance that would otherwise be primarily sedentary.

Figure 5:
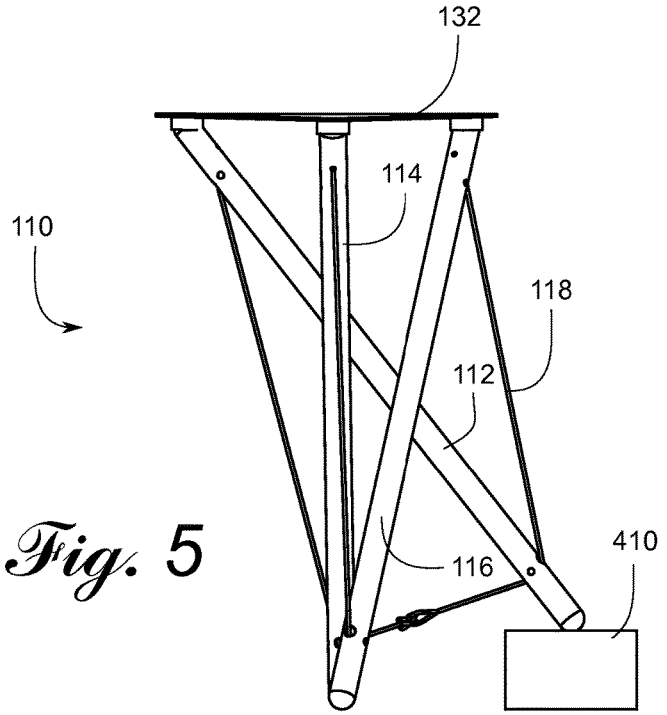
FIG. 5 is a side view of the base structure of FIG. 4.

FIG. 5 illustrates the tension-compression structure of FIG. 4, but in side view for an enhanced understanding of the structure and the relationship among the parts.

Figure 6:
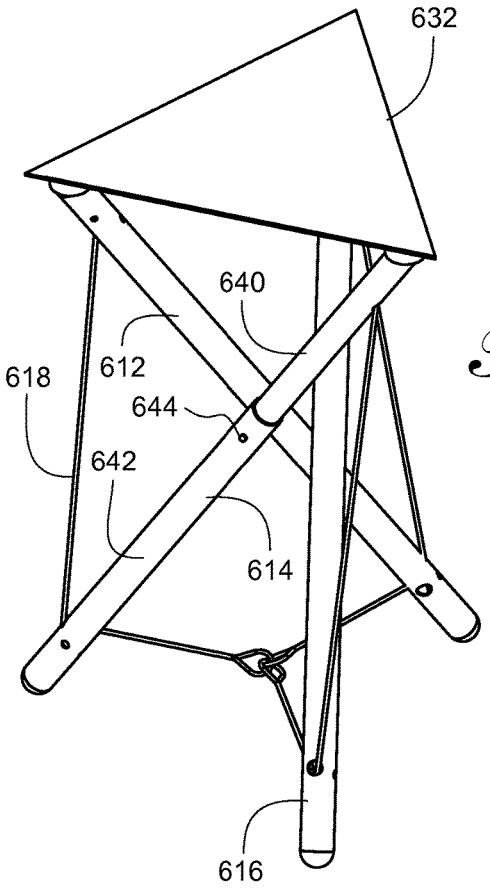
FIG. 6 illustrates a base structure according to the invention provided with a telescoping leg enabling the structure to be collapsed for storage or transportation.

FIG. 6 illustrates a base structure 610 according to the invention provided with a telescoping leg 614. The telescoping leg 614 enables the structure 610 to be collapsed for portability.

Figure 7:
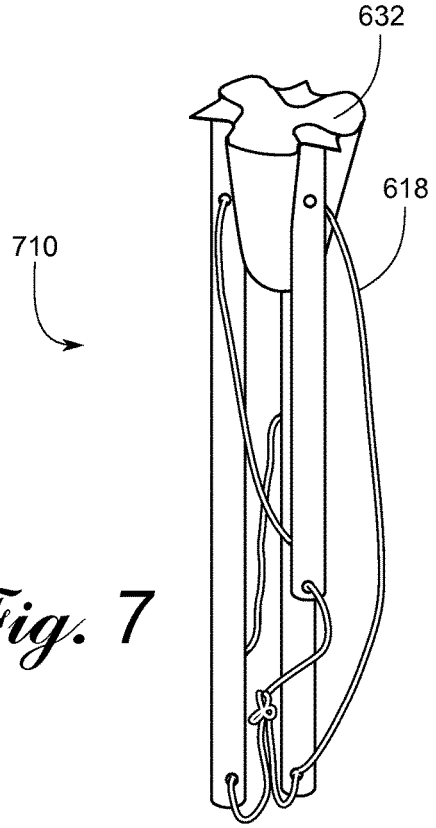
FIG. 7 is the base structure of FIG. 6 in its collapsed state.

As illustrated, one of the compression elements or legs 612, 614, and 616, is a telescoping leg 614 formed from two segments, an upper segment and a 640 lower segment 642. The upper segment 640 is slightly smaller in diameter than the lower segment 642, and hence, the upper segment 640 is capable of sliding axially into and out of the lower segment 642. To maintain the telescoping leg in its fully extended position, the upper segment is provided with a spring-biased pushbutton protrusion 644 at the lower end of the upper segment 640, configured to lock with a mating hole at an upper end of the lower segment 642. When the two segments 640 and 642 are so engaged, the protrusion extends through the hole in the lower segment and the two segments are kept in an extended configuration. To collapse the telescoping leg 614, the pushbutton 644 is depressed to disengage it from the hole, and the two segments 640 and 642 may then be slid together. This releases the tension on the tension elements 618, and allows the stool 610 of FIG. 6 to be collapsed into a bundle 710 (FIG. 7). In such a configuration, the upper platform 632 is desirably flexible, and is able to bend, fold, or otherwise conform with the collapsed bundle of legs. And the tension elements 618, being flexible, are also able to move and comply with the collapsed state 710 of the structure 610. Although a pushbutton 644 detent is described in some detail herein, it will be readily recognized that other locking structures are possible, such as twist locks and flip locks, as well as yet other alternatives that will be understood by a person of ordinary skill in mechanical design.

FIG. 7 is the base structure 610 of FIG. 6 in its collapsed state 710. In its collapsed state 710, a tension-compression structure according to the invention can be kept in a tube-shaped container or convenient shoulder bag, or strapped to a pack for easy transport. It should be noted that the tension elements 618 shown in FIG. 7 are illustrated in one possible slack state; the tension elements 618 can be arranged in other ways, tucked, wrapped, or folded around the compression elements 612, 614, and 616 and other portions of the structure 710 as desired.

Figure 8:
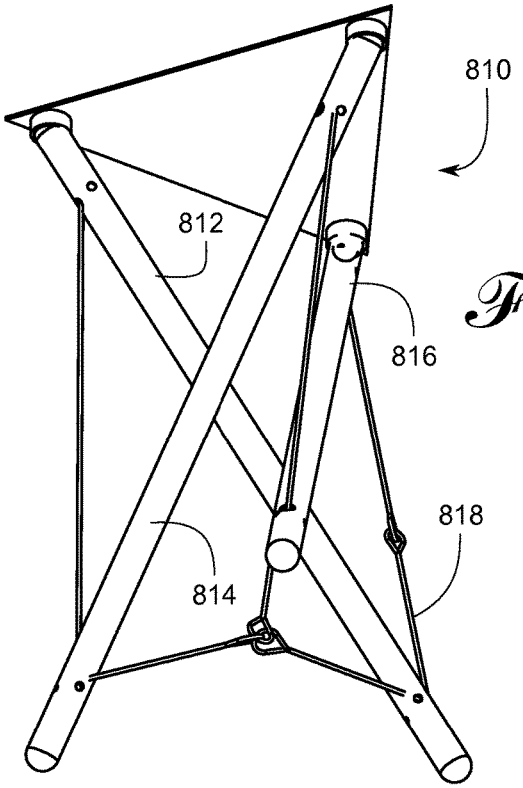
FIG. 8 illustrates a base structure according to the invention provided with a disconnectable tension element enabling the structure to be collapsed for storage or transportation.

FIG. 8 illustrates a base structure 810 according to the invention provided with a disconnectable tension element 818. Disconnecting this tension element 818 releases the tension and enables the structure 810 to be collapsed into a bundle 910 (FIG. 9) for storage or transportation.

The disconnectable tension element, in an embodiment of the invention, may take the form of a carabiner (on one end of the tension element 818) and loop (on the other end), or alternatively one of many different kinds of release mechanisms, including but not limited to plastic quick-disconnect clips, magnetic mechanisms, hooks, and many other possibilities. In an embodiment of the invention, the tension element 818 is not fully disconnected to collapse the structure, but is loosened sufficiently to allow the legs 812, 814, and 816 to move into a collapsed bundle 910 (FIG. 9); in this configuration, a strap buckle, turnbuckle, or lever apparatus may be used, and other options will be recognized by a practitioner of ordinary skill in the art.

Figure 9:
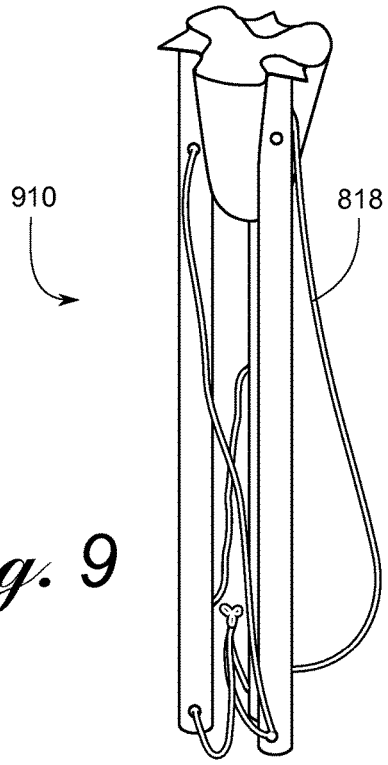
FIG. 9 is the base structure of FIG. 8 in its collapsed state.

FIG. 9 is the base structure 810 of FIG. 8 in its collapsed state 910. As with the embodiment of FIGS. 6-7, the structure resembles a bundle and can be easily stored or transported. As with FIG. 7, the tension elements 818 are shown in one possible collapsed configuration, and can be arranged in other ways as well.

Figure 10:
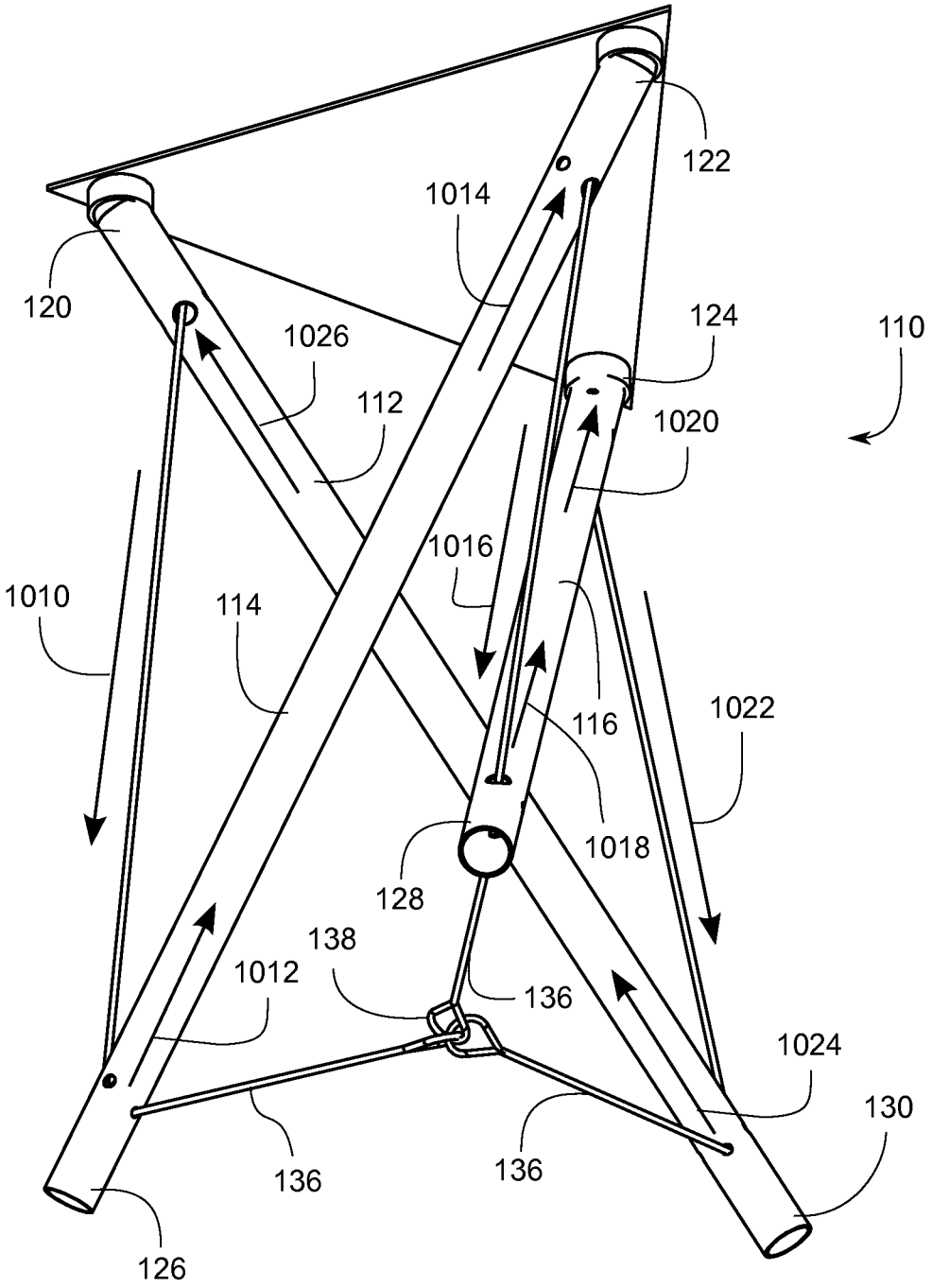
FIG. 10 is a depiction of a base structure according to the invention as seen from below, with arrows indicating a path of slidably adjustable tension elements.

FIG. 10 illustrates the path taken by the tension elements 118 in a base structure 110 according to the invention via arrows.

As discussed above in connection with FIG. 1, an embodiment of the invention includes tension elements 118 formed from a single loop of material, either as a closed loop or as an openable loop (as shown, for example, in FIGS. 8-9). The arrows in FIG. 10 illustrate an exemplary pathway for such a single closed or openable loop, inside each of the legs and connecting adjacent legs as described above. Although the arrows of FIG. 10 are shown as having a directionality, this is solely to enable an understanding and to more easily trace the entire path—it should be recognized that the tension elements are capable of sliding adjustability in both directions, not just in the direction represented by the arrows.

As shown in FIG. 10, starting somewhat arbitrarily at the upper end 120 of the first leg 112, the tension element 118 traverses the structure 110 externally along a first arrow 1010 to the lower end 126 of the second leg 114, then internally within the second leg along second and third arrows 1012 and 1014 to the upper end 122 of the second leg 114, then externally again along a fourth arrow 1016 to the lower end 128 of the third leg 116, then internally again along fifth and sixth arrows 1018 and 1020 to the upper end 124 of the third leg 116, then externally again along a seventh arrow 1022 to the lower end 130 of the first leg 120, then internally again along eighth and ninth arrows 1024 and 1026 to the upper end 120 of the first leg 112, closing the loop.

As noted above, the tension elements traverse the structure inside each of the legs 112, 114, and 116 and outside the legs (and between adjacent legs). As the tension elements transition between inside and outside of the legs, it is considered advantageous to provide a smooth and non-abrasive surface for them to slide over. Accordingly, the legs may be provided with saddle structures 1030, either internal to the legs or at the openings where the tension elements enter or exit the tubular legs. Such saddle structures 1030 provide the ability for the tension elements 118 and compression elements 112, 114, and 116 to move with respect to each other, while ensuring the tension elements 118 do not tend to fray over the course of time. The saddle structures 1030 also provide sufficient friction to ensure the tension-compression structure remains in a desired orientation and position without undue adjustment while it is being used. A practitioner of ordinary skill will recognize, of course, that the saddle structures may be replaced with pulleys, wheels, or simply flanged entry/exit holes or lips as desired; there are many other possibilities.

FIG. 10 shows the legs 112, 114, and 116 of the tension-compression structure held together at the bottom via a central junction 138 among three flexible constraint segments 136, as discussed above with reference to FIG. 1. It should be noted that an alternative arrangement uses constraint segments to connect the legs in a triangular configuration without a central junction; neither this path nor the configuration that includes a central junction is adapted for sliding adjustment, as it is intended to constrain the lower portions of the legs. Other configurations for a lower constraint may be apparent to a practitioner of ordinary skill, and shall be deemed to be within the scope of the invention.

It should be observed that while the present invention has been described as primarily a sitting stool, a tension-compression structure according to the invention may be used for numerous other applications other than stools. Other types of furniture (including broader chairs, tables, etc.), tables and other platforms, and equipment bases (substituting for a tripod, for example) may also be made according to the invention.

It should be observed that while the foregoing detailed description of various embodiments of the present invention is set forth in some detail, the invention is not limited to those details and a tension-compression structure made according to the invention can differ from the disclosed embodiments in numerous ways. In particular, it will be appreciated that embodiments of the present invention may be employed in differing applications and may be configured in various manners that may depart in some details from the exemplary details set forth above. It should be further noted that functional distinctions are made above for purposes of explanation and clarity; specific structural distinctions in an apparatus according to the invention may not be drawn along the same boundaries. Hence, the appropriate scope hereof is deemed to be in accordance with the claims as set forth below.

What is claimed is:

1. A tension-compression base structure comprising:

at least three independent, physically separate compression elements, each having a first end and a second end;

at least one tension element;

a constraint at the first end of the structure, the constraint directly attached to each of the first ends of the compression elements in a desired configuration;

wherein the at least one tension element connects one of the compression elements near the first end thereof to another of the compression elements near the second end thereof and wherein at least a portion of the at least one tension element extends generally parallel with an axis of at least one of the compression elements, holding the compression elements and the at least one tension element in a pre-stressed static equilibrium position; and wherein the at least one tension element is configured to be slidably adjusted with respect to at least the second ends of the compression elements.

2. The tension-compression base structure according to claim 1, wherein the base structure is configured as an item of furniture.

3. The tension-compression base structure according to claim 2, wherein the constraint comprises a seat.

4. The tension-compression base structure according to claim 3, wherein the base structure is configured as a stool.

5. The tension-compression base structure according to claim 1, wherein at least one of the compression elements is selectively axially collapsible to enable the base structure to be collapsed.

6. The tension-compression base structure according to claim 1, wherein the at least one tension element is selectively disconnectable from at least one of the compression elements to enable the base structure to be collapsed.

7. The tension-compression base structure according to claim 1, wherein the at least one tension element comprises a single loop.

8. A tension-compression base structure comprising:

at least three independent, physically separate compression elements, each having a first end and a second end;

at least one tension element;

a constraint at the first end of the structure holding each of the first ends of the compression elements in a desired configuration;

wherein the at least one tension element connects each of the compression elements near the first end thereof to an adjacent one of the compression elements near a second end thereof and wherein at least a portion of the at least one tension element extends generally parallel with an axis of at least one of the compression elements, holding the compression elements and the at least one tension element in a pre-stressed static equilibrium position; and wherein the at least one tension element is configured to be slidably adjusted with respect to at least the second ends of the compression elements.

9. The tension-compression base structure according to claim 8, wherein the base structure is configured as an item of furniture.

10. The tension-compression base structure according to claim 8, wherein the constraint comprises a seat.

11. The tension-compression base structure according to claim 8, wherein the base structure is configured as a stool.

12. The tension-compression base structure according to claim 8, wherein at least one of the compression elements is selectively axially collapsible to enable the base structure to be collapsed.

13. The tension-compression base structure according to claim 8, wherein the at least one tension element is selectively disconnectable from at least one of the compression elements to enable the base structure to be collapsed.

14. The tension-compression base structure according to claim 8, wherein the at least one tension element comprises a single loop.

15. A tension-compression base structure comprising:

at least three compression elements, each having a first end and a second end;

at least one tension element;

a constraint at the first end of the structure holding each of the first ends of the compression elements in a desired configuration;

wherein the at least one tension element extends through or along-side a length of each of the at least three compression elements and externally connects each of the compression elements near the first end thereof to an adjacent one of the compression elements near a second end thereof, holding the compression elements and the at least one tension element in a pre-stressed static equilibrium position; and wherein the at least one tension element is configured to be slidably adjusted with respect to at least the second ends of the compression elements.

16. The tension-compression base structure of claim 15, further comprising a plurality of tension segments interconnecting the at least three compression elements near a second end thereof.

17. The tension-compression base structure according to claim 15, wherein the base structure is configured as a stool.

18. The tension-compression base structure according to claim 15, wherein at least one of the compression elements is selectively axially collapsible to enable the base structure to be collapsed.

19. The tension-compression base structure according to claim 15, wherein the at least one tension element is selectively disconnectable from at least one of the compression elements to enable the base structure to be collapsed.

20. The tension-compression base structure according to claim 15, wherein the at least one tension element comprises a single loop.

* * * * *